US006557453B2

(12) United States Patent
Paakkunainen et al.

(10) Patent No.: US 6,557,453 B2
(45) Date of Patent: May 6, 2003

(54) HYDRAULIC BOOM CONTROL

(75) Inventors: Marko Paakkunainen, Tampere (FI); Ulf Bergquist, Woodstock (CA)

(73) Assignee: Timberjack Inc., Woodstock (CA)

( * ) Notice: Subject to any disclaimer, the term of this patent is extended or adjusted under 35 U.S.C. 154(b) by 0 days.

(21) Appl. No.: 09/822,727

(22) Filed: Mar. 30, 2001

(65) Prior Publication Data

US 2001/0045157 A1 Nov. 29, 2001

Related U.S. Application Data

(60) Provisional application No. 60/193,185, filed on Mar. 30, 2000.

(51) Int. Cl.[7] ..... F15B 11/00
(52) U.S. Cl. ..... 91/536; 91/420
(58) Field of Search ..... 91/420, 536

(56) References Cited

U.S. PATENT DOCUMENTS 3,862,697 A * 1/1975 Gill et al. ..... 414/694
5,263,400 A * 11/1993 Huesser ..... 91/420
6,443,196 B1 9/2002 Kurelek

OTHER PUBLICATIONS

Brochure of RSI Technologies Ltd. regarding "The Coordinator TM", undated admitted prior art.

* cited by examiner

*Primary Examiner*—Edward K. Look
*Assistant Examiner*—Thomas E. Lazo
(74) *Attorney, Agent, or Firm*—Quarles & Brady LLP

(57) ABSTRACT

A hydraulic boom control system has two valves controlling linear hydraulic actuators, one for pivoting a hoist boom relative to a machine and one for pivoting a stick boom relative to the hoist boom. The bore sides of the actuators are hydraulically connected and the rod side of the hoist actuator is connected to the first port of the first valve and to the second port of the second valve. Operating the first valve moves the boom end generally horizontally and operating the second valve moves it generally vertically.

38 Claims, 3 Drawing Sheets

HYDRAULIC BOOM CONTROL

CROSS-REFERENCE TO RELATED APPLICATIONS

This claims the benefit of U.S. Provisional Patent Application No. 60/193,185 filed Mar. 30, 2000.

FIELD OF THE INVENTION

This invention relates to hydraulically controlled arms, and in particular to a boom having a pivotally connected mast and a stick pivotally connected to the mast, wherein the positions of the mast and stick are controlled with hydraulic cylinders.

BACKGROUND OF THE INVENTION

The boom system plays a very important role in heavy mobile machines, like forestry machines. In forestry work, over 50% of the machine work time is maneuvering the boom. Thus, it is important that boom controls be operable with efficiency and smooth and logical response.

In mobile machines boom systems are normally hydraulically driven. Hydraulic systems are known for their outstanding power density and ability to generate high force.

A characteristic feature of boom hydraulics is the type of control used. Boom motions are almost always accomplished by hydraulic control valves, which typically have a smooth and logical response and are low in cost. However, there are also disadvantages related to valve control. The most important of these is poor efficiency. In hydraulics, valve control is sometimes referred to as loss control, because of the high losses associated with flowing high volumes of hydraulic fluid through valves with high pressure differentials.

The speed of movement of the boom is directly related to the speed of the boom actuator, typically a hydraulic cylinder, which is affected by the magnitude of the oil flow to or from the actuator. In valve control, flow magnitude is controlled by throttling, i.e., reducing or enlarging, the oil channels in the control valve.

The flow magnitude through a valve is largely determined by two factors. One factor is the valve opening, which is the size of the port that oil has to pass through, and the second is the pressure difference across the port. In the case of turbulent flow this can be expressed by the equation:

$$Q=K\cdot A\cdot\square\Delta p$$

where Q is flow, K is a constant related to the valve, A is the opening area of the port and Δp is the pressure difference across the port.

To illustrate the power loss in the valve port we can express the following equation:

$$P_{Loss}=Q\cdot\Delta p$$

This equation shows that the power loss increases as the flow and pressure difference increase.

In mobile machines, boom systems include multiple joints and actuators which are powered by a common pump. Referring to FIG. 1, in a typical system 10, a stick boom 20 is pivotally mounted by joint 24 to hoist boom 18, which is pivotally connected at joint 22 to the machine frame 34. A hoist actuator 14 is pivotally connected to the frame 34 at joint 26 and to the hoist boom 18 at joint 28. Stick actuator 16 is pivotally connected at joint 30 to the hoist boom 18 and at joint 32 to the stick boom 20. Stick actuator 16 is controlled by valve V1 and hoist actuator 14 is controlled by valve V2. In general, both valves V1 and V2 are supplied with pressurized hydraulic fluid from the same pump.

Typically, the actuators have different speed and load requirements. To ensure proper functioning of the system, the pump must deliver oil to the actuator valves according to at least the highest pressure demand. For valves serving a lower pressure load, a very high pressure difference can result in these valves, leading to a high power loss.

The worst case for boom system efficiency occurs when one actuator does positive work with high load thus causing a high pressure demand from the pump, while other actuators require fast motion with low load. In this situation much of the hydraulic energy is converted to heat in the low load valve ports. Another example relates to lifting and lowering of a load in a valve controlled system. If the load is first lifted upwards, the system must take energy (power) from the pump to do that. When the load is lowered back down, the system loses that energy in the valve control port. In such a case, the lowering energy can be stored in hydraulic accumulators. However, there are disadvantages like high cost and unreliability associated with hydraulic accumulators.

Another difficulty related to boom systems is the difficulty of handling. In forest machines like feller bunchers which have joint booms (as in FIG. 1), the driver has to control multiple joints of the boom at the same time. To reach a tree, for example, the driver has to control simultaneously, at least, the hoist, the stick and the tilt actuators. The working speed and smoothness of the boom end trajectory is highly dependent on the driver's capabilities.

One typical work cycle in forest machines is as follows:

1. Boom end (the cutting tool) is extended relatively horizontally outward to the tree to be cut.
2. The tree is cut by the tool.
3. The tree is lifted some amount.
4. The boom end holding the tree is retracted inwards.
5. The tree is felled (laid down or dumped) or the boom end is extended to the next tree to be cut if trees are to be accumulated by the head.

With the joint boom shown in FIG. 1, the boom end 12 horizontal trajectory is accomplished by maneuvering simultaneously the hoist actuator and the stick actuator. When the boom end 12 is extended, the hoist boom 18 must be driven downwards and the stick boom 20 upwards. This means that the hoist boom actuator 14 is doing negative work, that is braking work since it is falling under the influence of gravity, and the stick boom actuator 16 is doing positive work, being lifted against the effects of gravity. When the boom end 12 is retracted, the situation is the opposite: the hoist boom actuator 14 does positive work and the stick boom actuator 16 does negative work. The magnitude of the forces required depends on the load and the stroke length of the actuator. The load is mainly affected by the masses of the boom, the head (not shown) which is mounted at the end 12, and the tree(s) supported by the head.

In conventional valve controlled boom systems as illustrated schematically in FIG. 1, the braking work is accomplished by throttling the port of a control valve so as to reduce its area. Meanwhile the positive work required to be done is powered by the hydraulic pump, which has to provide pressurized oil to the other actuator via its control valve. A disadvantage of this system is that the braking energy is lost completely and is converted to heat in the valve port. In some cases, so much energy is lost that the hydraulic oil may become overheated.

SUMMARY OF THE INVENTION

The present invention improves handling of a boom system and diminishes power losses. By providing a hydraulic control system that directs the braking power of one actuator (or one set of actuators) to apply working power to a different actuator (or set of actuators), the braking power is not wasted, i.e., converted to heat, and less power is demanded from the pump to provide the working power.

In a preferred form, a hydraulic circuit for controlling the system has two valves, and the valves and actuator hydraulic circuits are set up so that one valve essentially controls horizontal movements, and the other valve can be used to control essentially vertical movements.

In a useful aspect, the gravity sides, i.e., those sides of the hoist and stick actuators which are pressurized by gravity, are connected by a common hydraulic line. Pressurizing the anti-gravity side, i.e., the side de-pressurized by gravity, of the hoist actuator extends the hoist boom and also pumps fluid from the gravity side of the hoist actuator to the gravity side of the stick actuator, which extends the stick boom. The result is that the end of the boom extends in a largely horizontal direction with the operation of only one valve, and gravity helps pump fluid to extend the stick actuator.

Retraction in a largely horizontal direction results from shifting the same valve in the opposite direction, so as to connect the anti-gravity side of the hoist actuator with tank and pressurize the anti-gravity side of the stick actuator. The gravity side of the stick actuator pumps fluid to the gravity side of the hoist actuator so that the action of both actuators contributes to retracting the end of the boom in a largely horizontal direction.

Largely vertical motion of the end of the boom is accomplished using the other valve, by extending or retracting the hoist actuator.

Thus, the invention provides a pivoting boom control system which is easier to control for largely horizontal and vertical motions and more power efficient.

These and other objects and advantages of the invention will be apparent from the detailed description and drawings.

DETAILED DESCRIPTION OF THE PREFERRED EMBODIMENT

Figure 2:
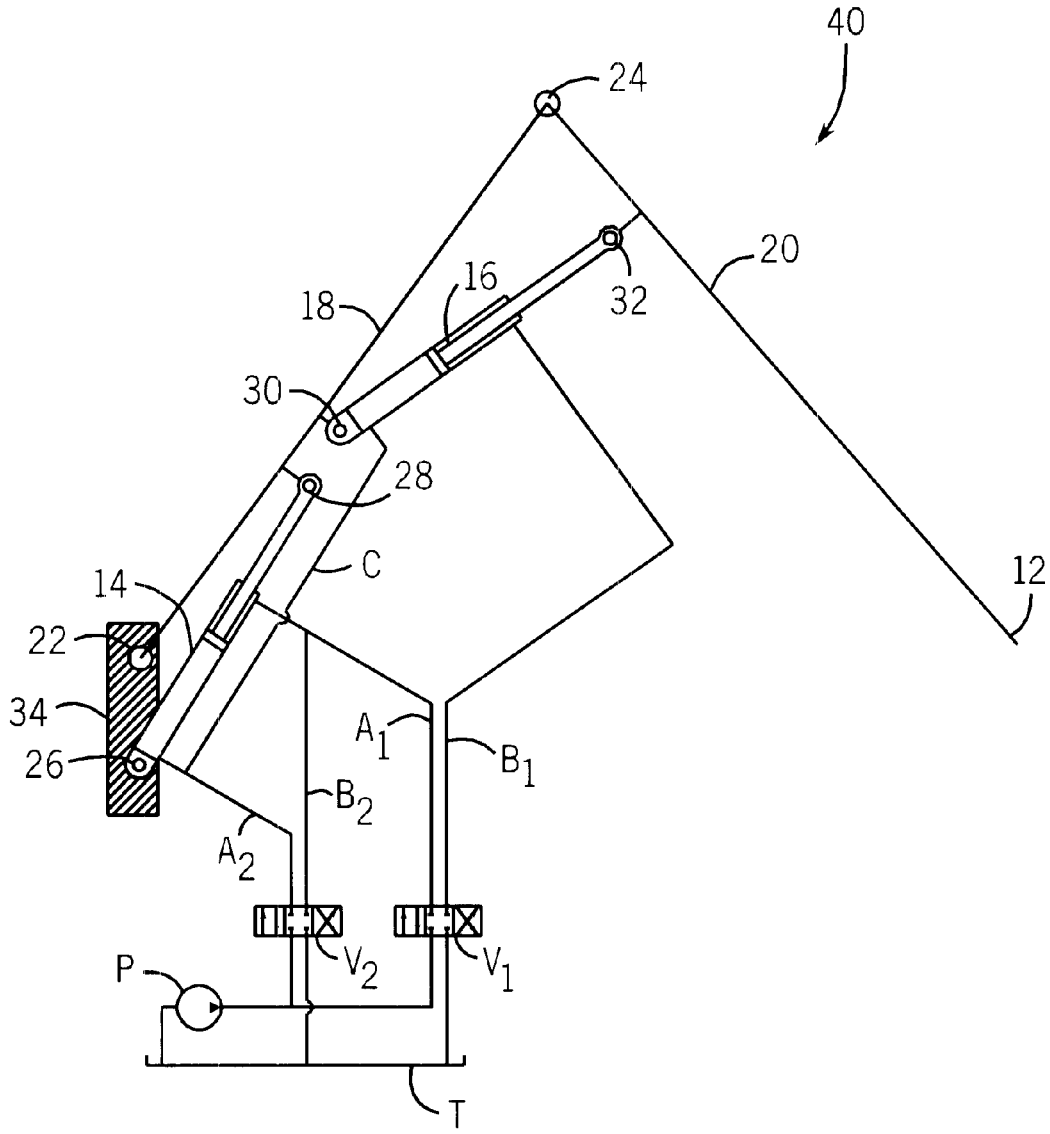
FIG. 2 is a schematic plan view of a boom hydraulic control circuit of the invention.

FIG. 2 is a schematic representation of a boom control system 40 of the invention. In FIG. 2, the bore sides of the hoist and stick boom actuators 14, 16 are pressurized by the weight of the boom, head and any trees held by head (or other load at the end 12) and therefore are referred to herein as the gravity sides. The rod sides of the actuators 14, 16 are depressurized by the weight of the boom and load, and therefore are referred to herein as the anti-gravity sides of the actuators 14, 16. Either the bore sides or the rod sides could be the gravity sides, with the other sides being the anti-gravity sides, depending upon the arrangement of the actuators.

In FIG. 2, the gravity sides, which as stated above are the bore sides in the embodiment of FIG. 2, of the actuators 14, 16 are connected to each other by channel C and they are controlled together by four way three position (4/3) control valve V1 via channels A and B.

To effect largely horizontal movements of the boom end 12, both channels of 4/3 valve V2 are closed (center valve position) and only valve V1 is operated. Other types of control valves can be used for V1 and V2, such as 6/3 valves, but they are not necessary for practicing the invention. The invention provides largely horizontal movement by operation of the valve V1, with one of the actuators working as a pump and the other as a motor, with each able to perform both functions at different times.

When extending the boom end 12 horizontally outward, shifting control valve V1 rightwardly from the position shown in FIG. 2 provides oil from the pump P to the rod side of the hoist actuator 14 via channel $A_1$, thus causing the hoist actuator 14 to retract. The mass of the boom system and the load also helps provide the force needed to extend the boom, thereby making the pressure required in channel $A_1$ from the pump P relatively low, thus reducing the supply pressure needed. Because the bore side of the hoist cylinder 14 is connected to the bore side of the stick cylinder 16 by channel C, the oil that exits the bore side of the hoist cylinder 14 is provided to the bore side of the stick cylinder 16 to extend it. The stick cylinder 16 rod side is connected via channel $B_1$ to the control valve V1 and from the valve V1 to the tank T. During extension, the stick cylinder 16 moves against gravity, acting to enlarge the included angle between the hoist 18 and stick 20.

When the boom end 12 is retracted, valve V2 is kept closed and valve V1 is shifted leftwardly to connect $A_1$ with tank T and $B_1$ with pump P and the actuators 14, 16 change their roles, with the stick cylinder 16 acting as a pump and the hoist cylinder 14 acting as a braking motor, i.e., to extend the hoist actuator 14 so as to lift the hoist 18 and to retract the stick actuator 16 so as to reduce the included angle between the hoist 18 and stick 20. When retracting, oil is pumped to the anti-gravity (rod) side of the stick actuator 16 through channel $B_1$ of valve V1 and oil from the anti-gravity (rod) side of the hoist actuator 14 is exhausted through channel $A_1$ of valve V1 to tank T.

Valve V2 in FIG. 2 is connected to the rod and bore sides of the hoist actuator and controls essentially vertical movements of the boom system, for which valve V1 is kept closed. With both lines $A_1$ and $B_1$ of valve VI closed, pump pressure supplied by valve V2 to its line $A_2$ (in rightward shifted position of valve V2) leading to the bore side of the hoist cylinder 14 extends the hoist cylinder 14, thereby lifting the hoist 18 and therefore lifting the end 12 of the boom. Oil is expelled from the rod side of the hoist cylinder 14 to tank T through line $B_2$ leading to valve V2. Oil is also pumped to the bore side of the stick actuator 16 via line C, but no movement of stick actuator 16 is effected, since the rod side of actuator 16 is blocked by valve V1. Thus pivoting takes place of end 12 about joint 22, where the hoist 18 is connected to the frame 34. To lower the boom end 12, valve V2 is shifted leftwardly, while maintaining valve V1 closed, which pressurizes the rod side of hoist actuator 14 and connects the bore side with tank pressure. The bore side of stick actuator 16 is also connected to tank pressure, but since the rod side of cylinder 16 is blocked, very little if any motion of actuator 16 is effected, and most if not all of the lowering of the boom end 12 is due to the retraction of the hoist cylinder 14.

Figure 1:
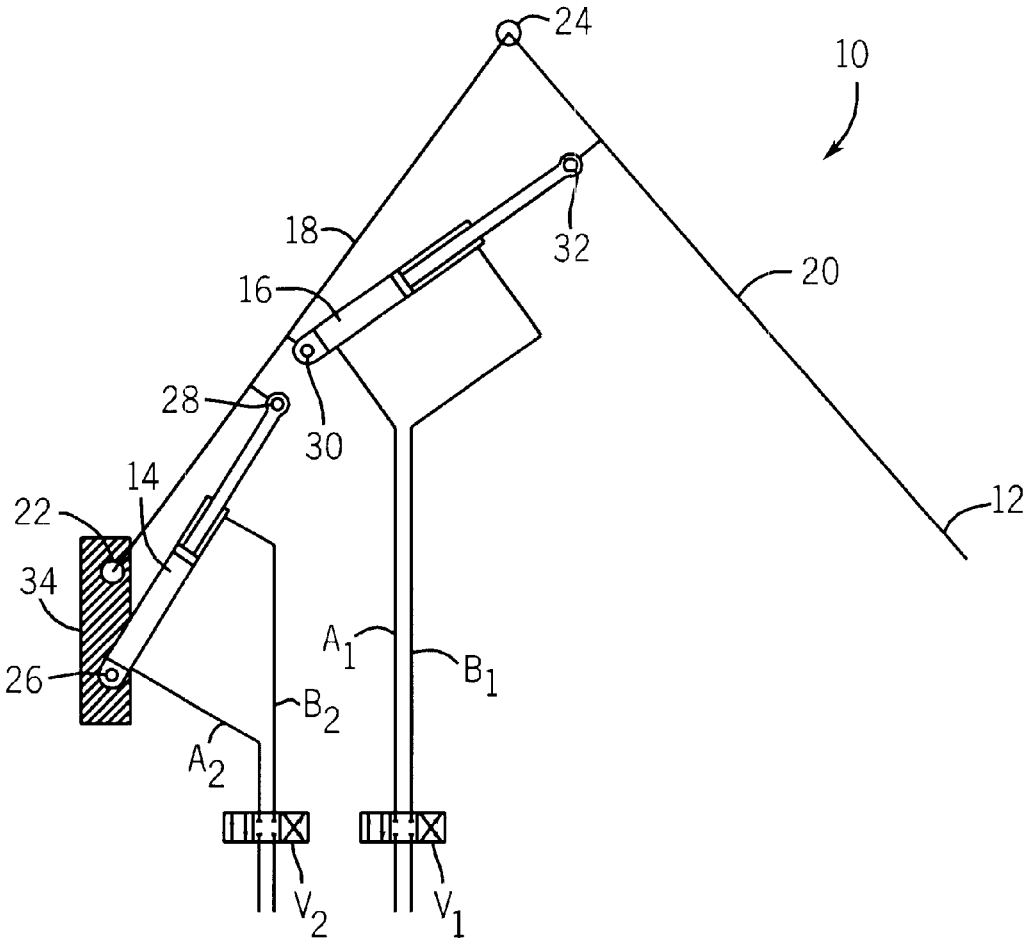
FIG. 1 PRIOR ART
FIG. 1 is a schematic plan view of a typical prior art boom hydraulic control circuit.

Since valve V1 controls essentially boom end 12 horizontal motion and valve V2 controls essentially vertical motion, a system of the invention is very logical to use compared to the conventional system of FIG. 1.

Figure 3:
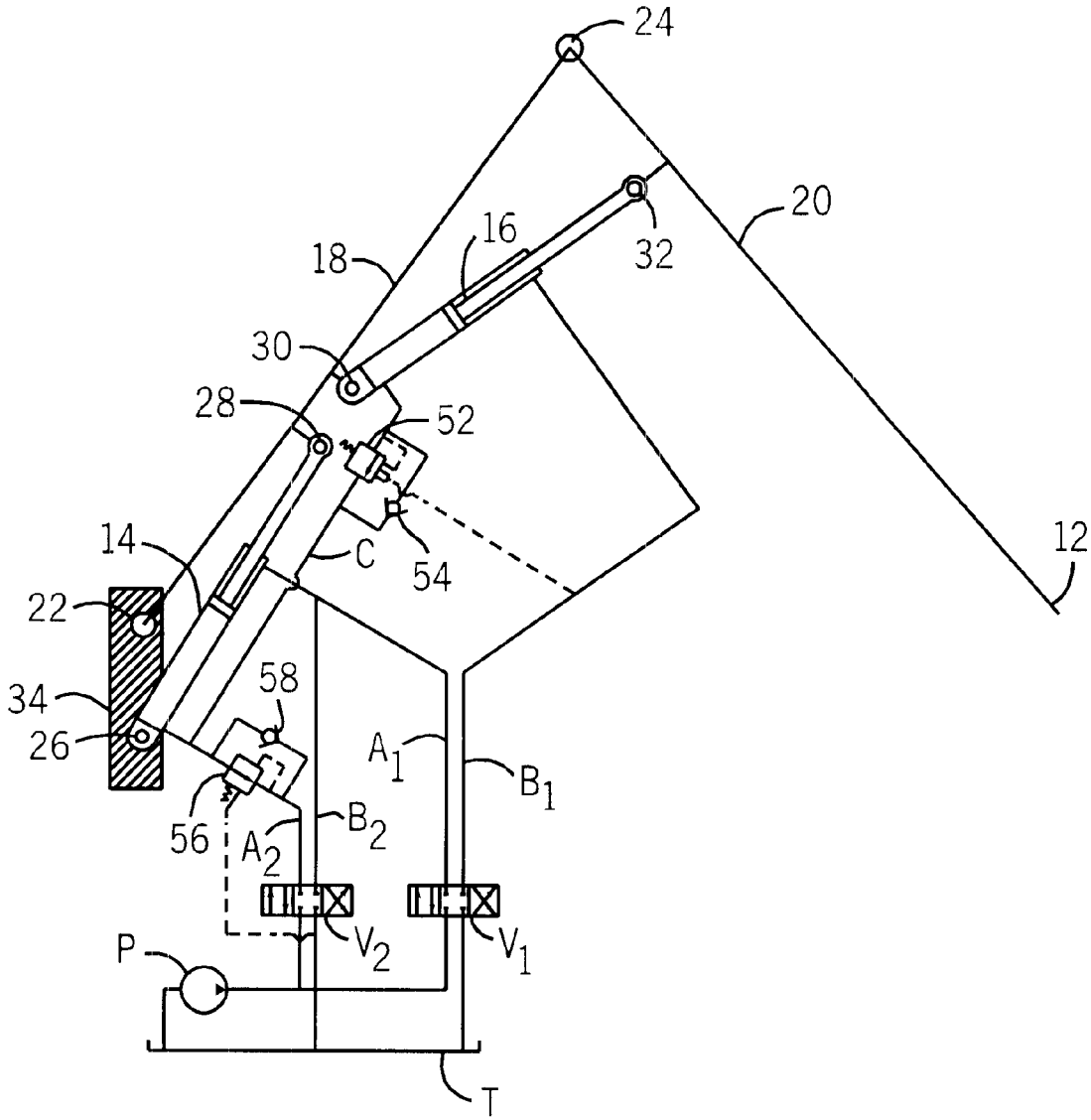
FIG. 3 is a schematic plan view of a modification to the boom hydraulic control circuit of FIG. 2.

FIG. 3 illustrates a modified system 50, which is a modification to the system 40. In the system 50, undesired retracting of the stick actuator 16, particularly when lowering the boom end 12, is prevented by a counter-balance valve 52. This pressure operated relief valve permits flow from the bore side of stick actuator 16 to the bore side of hoist actuator 14 or to line $A_2$ only when the pressure in the bore side or especially the rod side of actuator 16 is great enough to open the valve 52. The result is that the lowering of the end 12 is essentially carried out by the actuator 14 and as a rotation in the joints 22 and 26. Thus, when lowering the end 12 in the system 40 of FIG. 2 by opening valve V2 with line $A_2$ connected to tank, whichever actuator 14 or 16 has the higher load (pressure) retracts. In the system 50 of FIG. 3, the actuator 16 retracts practically only when the pressure in the line B1 is high enough to open valve 52. In a simple lowering case, when valve V1 is closed, the rod side of actuator 16 is near vacuum pressure. As long as valve 52 remains closed in this case, actuator 16 does not move. However, when valve V1 is operated to retract end 12 horizontally, the pressure in the actuator 16 bore side opens valve 52 to provide fluid under pressure to the bore side of cylinder 14. One way check valve 54 permits free flow in the opposite direction, from the bore side of hoist cylinder 14 to the bore side of stick cylinder 16, so that horizontal extension of the boom end 12 is not inhibited by the check valve 52.

If the driver wants to lower and extend the boom at the same time, the system 40 acts according to the actual load conditions in the actuators 14 and 16. If the actuator 16 has (essentially) higher load (pressure) on its bore side than the actuator 14 on its bore side the flow from the hoist cylinder 14 bore side tends to go to tank through the valve V2 rather than to the bore side of actuator 16. In practise, this means that the speed of boom extension decreases and the speed of the boom lowering increases. To avoid this unwanted load dependency of the system 40, in the system 50 line $A_2$ is equipped with a pressure compensation valve 56 to provide a constant pressure drop between the line $A_2$ and tank line of the valve V2. The constant pressure drop causes the flow through the valve V2 meter out orifice to depend only on the valve opening of valve V2 and not on the load conditions.

The one way check valve 58 has been added to permit the free flow of fluid from the pump P to the bore sides of the actuators 14 and 16 when the pump P is connected to them by valve V2.

Thus, a system of the invention efficiently uses pressure provided by the force of gravity in one cylinder to power another cylinder of the boom system against the force of gravity, both when extending and retracting the end of the boom. Also a system of the invention preferably has pressure operated control valves 54 and 56 with adjacent check valves to prevent or decrease undesired motion characteristics. In addition, in a system of the invention, one control valve is used by an operator to control the boom end horizontally, and the other is used by the operator to control vertical motions of it.

In a boom system of the invention, the hoist arm is pivotally connected to the frame of the machine to be pivotable about a first generally horizontal axis, and the stick arm is pivotally connected to the hoist to be pivotable about a second generally horizontal axis, generally parallel to the first axis. The two arms, in normal operation when extending or retracting the end of the boom, move in opposite directions relative to gravity, with one moving with gravity and the other moving against it. A hydraulic actuator is provided to move each arm, with the hoist actuator pivotally connected between the machine frame and the hoist and operative to pivot the hoist relative to the machine frame, and the stick actuator pivotally connected between the hoist and the stick and operative to pivot the stick relative to the hoist. The first port of a first valve is in communication with the rod side of the hoist cylinder, and the rod side of the hoist cylinder is also in communication with the second port of a second valve. The bore sides of the two actuators are in communication with each other and with the first port of the second valve. The second port of the first valve is in communication with the rod side of the stick cylinder.

Thus, hydraulic fluid is pumped, in one direction or the other, dependent upon the desired direction of boom end horizontal movement, between the bore sides of the two actuators, depending upon which of the actuators has its rod side pressurized using the first valve. The rod side of the actuator which is acting in the direction of gravity has its rod side pressurized, using the first valve, to effect the movement in one direction or the other, since in both of the directions, a different one of the arms moves with gravity and the other arm moves against gravity. The rod side of whichever actuator is moving against gravity is vented to tank pressure by the first valve when the bore side of that cylinder is supplied with pump pressure by the same valve, during which both ports of the second valve may be held closed. Both ports of the first valve may be held closed while the second valve is operated to raise and lower the hoist arm, and therefore to raise and lower the end of the boom.

It should be understood that although a single actuator is illustrated for each boom, each single actuator could be replaced with a set of two or more actuators.

Many modifications and variations to the preferred embodiment described will be apparent to those skilled in the art, which still embody the spirit and scope of the invention. Therefore the invention should not be limited to the preferred embodiment described, but should be defined by the claims which follow.

We claim:

1. In a hydraulic boom control system for controlling the pivotal movement of a hoist boom relative to a machine frame and a stick boom relative to the hoist boom, said system including at least one hydraulic actuator for pivoting said hoist boom relative to said machine frame and at least one hydraulic actuator for pivoting said stick boom relative to said hoist boom, each said actuator having a gravity side which is pressurized by the gravity loading of said booms on said actuator and each said actuator having an anti-gravity side which is depressurized by the gravity loading of said booms on said actuator, the gravity sides of said actuators being one set of sides and the anti-gravity sides of said actuators being another set of sides, the improvement comprising a common hydraulic line connecting the sides of one set of sides, and wherein the sides of the other set of sides are not connected to each other.

2. The improvement of claim 1, wherein said system includes at least two control valves.

3. The improvement of claim 1, wherein said common hydraulic line connects gravity sides of said actuators.

4. The improvement of claim 1, further comprising a control valve operable by a user to operate at least one of said actuators and a hydraulic line which connects said common hydraulic line to said control valve, said hydraulic line including a meter out compensator valve.

5. The improvement of claim 4, wherein said meter out compensator valve helps maintain a constant pressure drop across said control valve in at least one position of said control valve.

6. The improvement of claim 5, wherein said at least one position of said control valve is a position in which said control valve connects an outlet port of said meter out compensator valve to tank.

7. The improvement of claim 1, wherein said actuators are linear actuators.

8. In a hydraulic boom control system for controlling the pivotal movement of a hoist boom relative to a machine frame and a stick boom relative to the hoist boom, said system including at least one hydraulic actuator for pivoting said hoist boom relative to said machine frame and at least one hydraulic actuator for pivoting said stick boom relative to said hoist boom, each said actuator having a gravity side which is pressurized by the gravity loading of said booms on said actuator and each said actuator having an anti-gravity side which is depressurized by the gravity loading of said booms on said actuator, the gravity sides of said actuators being one set of sides and the anti-gravity sides of said actuators being another set of sides, the improvement comprising a common hydraulic line communicating the sides of at least one set of sides with one another; wherein said system includes at least two control valves; and wherein at least one of said actuators has one of its sides connected to both of said valves.

9. The improvement of claim 8, wherein said one of said sides connected to both of said valves of said at least one of said actuators is an anti-gravity side of said at least one of said actuators.

10. The improvement of claim 9, wherein said one of said actuators is the hoist actuator.

11. In a hydraulic boom control system for controlling the pivotal movement of a hoist boom relative to a machine frame and a stick boom relative to the hoist boom, said system including at least one hydraulic actuator for pivoting said hoist boom relative to said machine frame and at least one hydraulic actuator for pivoting said stick boom relative to said hoist boom, each said actuator having a gravity side which is pressurized by the gravity loading of said booms on said actuator and each said actuator having an anti-gravity side which is depressurized by the gravity loading of said booms on said actuator, the gravity sides of said actuators being one set of sides and the anti-gravity sides of said actuators being another set of sides, the improvement comprising a common hydraulic line communicating the sides of at least one set of sides with one another; wherein said common hydraulic line includes a counter balance valve.

12. The improvement of claim 11, wherein said common hydraulic line connects gravity sides of said actuators.

13. In a hydraulic boom control system for controlling the pivotal movement of a hoist boom relative to a machine frame and a stick boom relative to the hoist boom, said system including at least one hydraulic actuator for pivoting said hoist boom relative to said machine frame and at least one hydraulic actuator for pivoting said stick boom relative to said hoist boom, each said actuator having a gravity side which is pressurized by the gravity loading of said booms on said actuator and each said actuator having an anti-gravity side which is depressurized by the gravity loading of said booms on said actuator, the gravity sides of said actuators being one set of sides and the anti-gravity sides of said actuators being another set of sides, the improvement comprising a common hydraulic line communicating the sides of at least one set of sides with one another, a control valve operable by a user to operate at least one of said actuators and a hydraulic line which connects said common hydraulic line to said control valve, said hydraulic line including a meter out compensator valve that helps maintain a constant pressure drop across said control valve in at least one position of said control valve, wherein said gravity sides of said actuators are connected by said common hydraulic line, and said gravity sides include at least one bore side of at least one of said actuators.

14. The improvement of claim 13, further comprising a control valve operable by a user to operate at least one of said actuators and a hydraulic line which connects said common hydraulic line to said control valve, said hydraulic line including a meter out compensator valve.

15. The improvement of claim 14, wherein said meter out compensator valve helps maintain a constant pressure drop across said control valve in at least one position of said control valve.

16. The improvement of claim 15, wherein said at least one position of said control valve is a position in which said control valve connects said meter out compensator valve to tank.

17. In a hydraulic boom control system for controlling the pivotal movement of a hoist boom relative to a machine frame and a stick boom relative to the hoist boom, said system including at least one hydraulic actuator for pivoting said hoist boom relative to said machine frame and at least one hydraulic actuator for pivoting said stick boom relative to said hoist boom, each said actuator having a gravity side which is pressurized by the gravity loading of said booms on said actuator and each said actuator having an anti-gravity side which is depressurized by the gravity loading of said booms on said actuator, the gravity sides of said actuators being one set of sides and the anti-gravity sides of said actuators being another set of sides, the improvement comprising a common hydraulic line connecting at least one of the sets of sides, and wherein said actuators are connected to at least two control valves, each control valve being controllable independently of the other control valve.

18. The improvement of claim 17, wherein one of said valves is controllable for generally horizontal movement and the other valve is controllable for generally vertical movement.

19. The improvement of claim 17, wherein at least one of said actuators has one of its sides connected to both of said valves.

20. The improvement of claim 17, wherein both control valves are at least indirectly connected to at least one of said actuators.

21. The improvement of claim 17, wherein said common hydraulic line connects gravity sides of said actuators.

22. The improvement of claim 17, wherein an anti-gravity side of at least one of said actuators is connected to both of said valves.

23. The improvement of claim 22, wherein said one of said actuators is the hoist actuator.

24. The improvement of claim 17, wherein the sides of the set not connected by said common hydraulic line are not connected to each other.

25. In a hydraulic boom control system for controlling the pivotal movement of a hoist boom relative to a machine frame and a stick boom relative to the hoist boom, said system including at least one hydraulic actuator for pivoting said hoist boom relative to said machine frame and at least one hydraulic actuator for pivoting said stick boom relative to said hoist boom, each said actuator having a gravity side which is pressurized by the gravity loading of said booms on said actuator and each said actuator having an anti-gravity side which is depressurized by the gravity loading of said booms on said actuator, the gravity sides of said actuators being one set of sides and the anti-gravity sides of said actuators being another set of sides, the improvement comprising:

a common hydraulic line connecting at least one of the sets of sides; and a pair of control valves, wherein both of said control valves are connected to at least one of said actuators.

26. The improvement of claim 25, wherein at least one of said actuators has one of its sides connected to both of said valves.

27. The improvement of claim 25, wherein said common hydraulic line connects gravity sides of said actuators.

28. The improvement of claim 25, wherein an anti-gravity side of at least one of said actuators is connected to both of said valves.

29. The improvement of claim 28, wherein said one of said actuators is the hoist actuator.

30. The improvement of claim 25, wherein the sides of the pair not connected by said common hydraulic line are not connected to each other.

31. The improvement of claim 25, wherein each said actuator is directly connected to at least one control valve.

32. In a hydraulic boom control system for controlling the pivotal movement of a hoist boom relative to a machine frame and a stick boom relative to the hoist boom, said system including at least one hydraulic actuator for pivoting said hoist boom relative to said machine frame and at least one hydraulic actuator for pivoting said stick boom relative to said hoist boom, each said actuator having a gravity side which is pressurized by the gravity loading of said booms on said actuator and each said actuator having an anti-gravity side which is depressurized by the gravity loading of said booms on said actuator, the gravity sides of said actuators being one set of sides and the anti-gravity sides of said actuators being another set of sides, the improvement comprising:

a common hydraulic line connecting at least one of the sets of sides; and at least two control valves connected to said actuators, wherein at least one of said actuators has one of its sides connected to both of said control valves.

33. The improvement of claim 32, wherein said common hydraulic line connects gravity sides of said actuators.

34. The improvement of claim 32, wherein an anti-gravity side of at least one of said actuators is connected to both of said valves.

35. The improvement of claim 34, wherein said one of said actuators is the hoist actuator.

36. The improvement of claim 32, wherein the sides of the set of sides not connected by said common hydraulic line are not connected to each other.

37. The improvement of claim 32, wherein each said actuator is directly connected to at least one control valve.

38. The improvement of claim 32, wherein wherein both of said control valves are connected to at least one of said actuators.

* * * * *